United States Patent [19]

Jurgensen

[11] Patent Number: 4,683,677

[45] Date of Patent: Aug. 4, 1987

[54] POWER BEAM FOR ROTATING STRUCTURAL MEMBER

[76] Inventor: Bruce A. Jurgensen, 3412 - 17th Ave., Forest Grove, Oreg. 97116

[21] Appl. No.: 828,096

[22] Filed: Feb. 10, 1986

Related U.S. Application Data

[63] Continuation-in-part of Ser. No. 739,555, May 30, 1985, abandoned.

[51] Int. Cl.[4] ..... E05F 11/00

[52] U.S. Cl. ..... 49/200; 52/113; 52/121

[58] Field of Search ..... 52/113, 116–119, 52/121; 49/200, 199

[56] References Cited

U.S. PATENT DOCUMENTS 3,313,062 4/1967 Dugger ..... 49/200

FOREIGN PATENT DOCUMENTS 2158927 5/1973 Fed. Rep. of Germany ..... 49/200

934845 8/1963 United Kingdom ..... 49/199

*Primary Examiner*—William F. Pate, III
*Assistant Examiner*—Naoko N. Slack
*Attorney, Agent, or Firm*—Norman E. Reitz

[57] ABSTRACT

A power beam converts a linear force into a torque. The beam is slideably positioned transverse to a structural member to be rotated and adjacent a hinged connection of the structural member to a frame. The beam is driven in a linear direction by a motive means such as a hydraulic cylinder, cable network or threaded shaft and actuation nut. A cable extends from its connection to the structural member at a set distance from the hinged connection, over the end of the slideable beam and then to a bias means, typically a spring. To rotate the structural member, the slideable beam is driven transverse to the structural member to impart a force along the cable the spring travels to its limit and thereafter a significant force is applied to the structural member to rotate the structural member.

11 Claims, 12 Drawing Figures

POWER BEAM FOR ROTATING STRUCTURAL MEMBER

This is a continuation-in-part of co-pending application Ser. No. 739,555 filed on 5-30-85, abandoned.

This invention relates to a means of rotating a vertical structure to a horizontal position and, more particularly, relates to a slideable beam which imparts a torque through a cable to a vertical structure which is hinged to a frame to thereby rotate the vertical structure to a horizontal position.

The rotation of an object about an axis is known to require the application of a sufficient torque. Such a torque may be produced by applying a force at an appropriate angle and at a sufficient distance from the axis of rotation. However, due to space limitations or to design considerations, it may not be convenient to apply such a force at the particular location where the torque could readily be generated. This constraint may be particularly present with structures where the member is required to be rotated infrequently or where the means for supplying the torque should not be present or visible when rotation is not being accomplished. In such instances, it would be desirable to provide a means for applying torque,when needed which will not be visually perceptible at other times or otherwise interfere with the intended application.

In the co-pending application of Bruce A. Jurgensen, "Expandable Structure and Sequence of Expansion," Ser. No. 739,607, filed on May 30, 1985, an expandable structure has been proposed in which the floor space of a core structure is expanded by deploying at least one contiguous expanded section. As disclosed therein, at least a portion of a selected sidewall of the core structure is rotated about a hinged connection with the frame of the core structure to form the roof of the contiguous expanded section. The unexpanded mode of such an expandable structure is shown in FIG. 3. To deploy the expanded section, it is necessary to rotate the selected sidewall/roof 20 to a near horizontal position, as shown in FIG. 8. The reverse procedure must be carried out when the expandable structure is collapsed. In rotating this selected sidewall/roof 20 or any comparable vertical, hinged member, it would be impractical to utilize such means as crane members on the roof of the structure or direct thrust hydraulic means at the bottom of the sidewall since the size and extent of the travel of the units would be extreme. It would also be impractical to deploy commercial or industrial units by hand due to the size and weight of the vertical structures. In addition, such hardware could interfere with subsequent operations. Thus, it would be desirable to provide simple but effective means to rotate the vertical selected sidewall into a horizontal roof position whenever necessary but which will not interfere with the subsequent operation and which will be unobtrusive at other times.

SUMMARY OF THE INVENTION

The power beam of the present invention converts a linear force into a significant torque for the purpose of rotating a hinged structural member. The power beam is positioned adjacent the member to be rotated and comprises a beam which slides within a hollow beam channel, a motive means such as a hydraulic cylinder, cable network or threaded shaft and nut for driving the slideable beam, and a cable which runs over an end of said slideable beam and between the member and a connection with a spring. The spring holds the cable taut and has a fixed length of travel, the end point of which determines the point at which torque begins to be imparted to the structural member. In operation, the motive means drives the slideable beam through the beam channel outwardly and against the cable until the end of travel of the spring is reached. Thereafter, as the slideable beam continues to move outwardly the force imparted along the cable applies a torque to the hinged structural member which gradually rotates the structural member from a vertical to a horizontal position.

BRIEF DESCRIPTION OF THE DRAWINGS

For a more complete understanding of the power beam of the present invention, reference may be had to the accompanying drawings which are incorporated herein by reference and in which.

DESCRIPTION OF THE PREFERRED EMBODIMENTS

Figure 3:
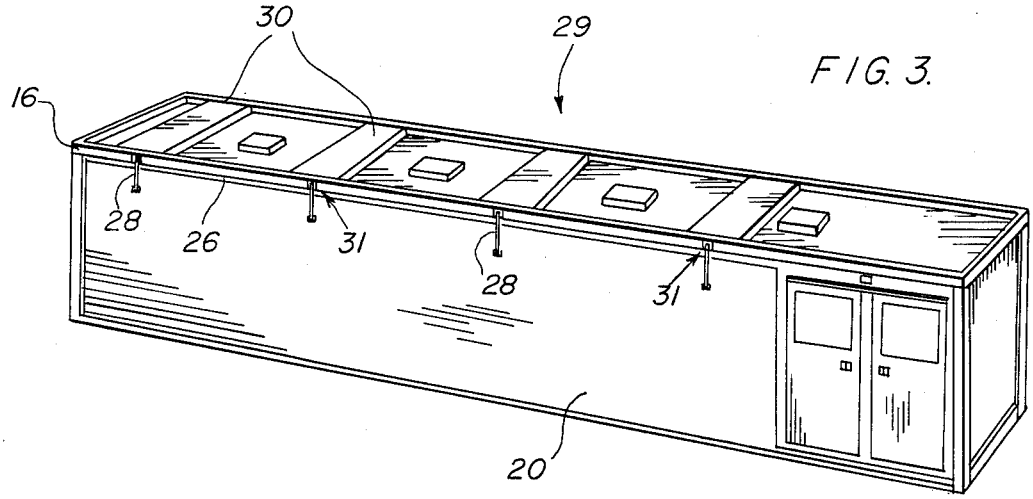
FIG. 3 is perspective view of an expandable structure in which power beams in accordance with the present invention are housed within enclosures on the roof of the core structure.
Figure 8:
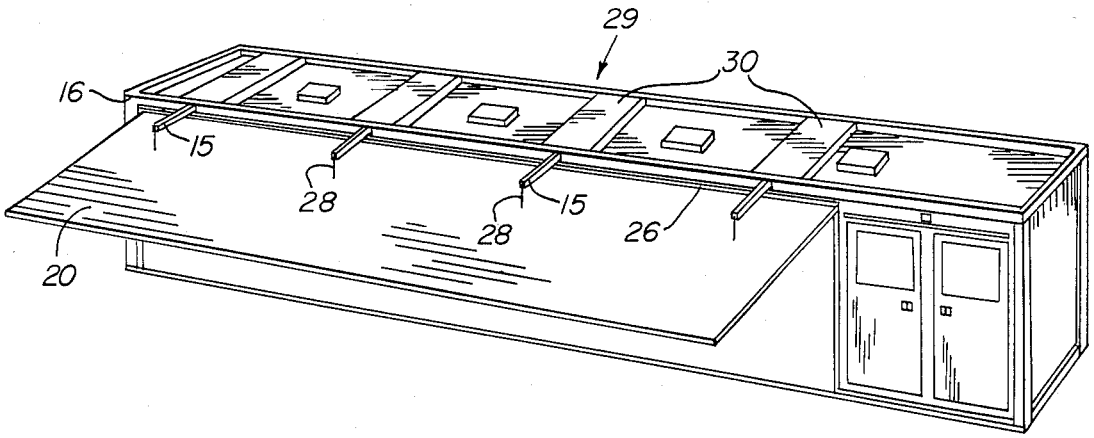
FIG. 8 is a perspective view of the expanded structure of FIG. 3 with the selected sidewall/roof raised to a near horizontal position.

In this specification the term "power beam" is used to designate a complete apparatus for converting linear motion into rotational motion. A particular motive means such as hydraulic, electrical or mechanical produces a linear force which is converted by the apparatus into a torque to produce the rotation of a structure about an axis or a hinged connection. As shown in FIGS. 3 and 8, such power beams 31 may be enclosed in power beam enclosures 30 located on the roof of a core structure 29. When needed they can be actuated to rotate the selected sidewall/roof 20 about the hinge 26 from a vertical to a horizontal position. In the fully retracted position, no portion of the beam hardware extends outside the frame. At all times a minimal volume is occupied by the power beam and power beam enclosure 30.

Figure 1:
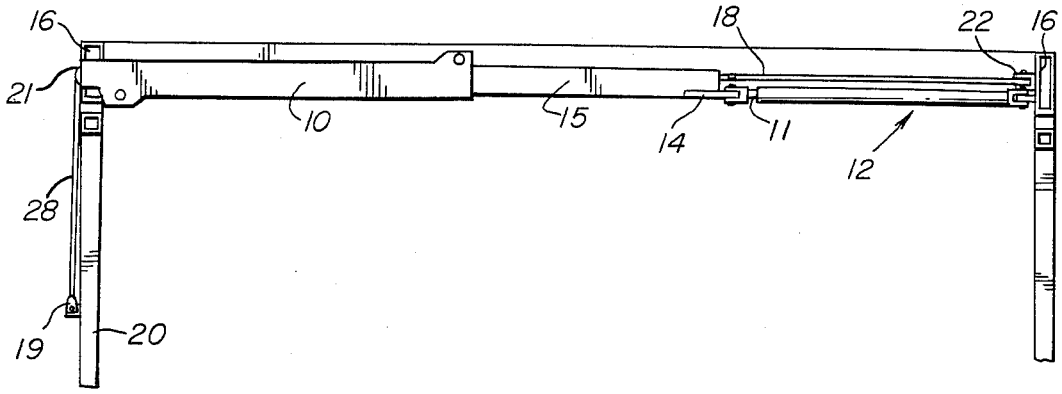
FIG. 1 is a side view of the power beam in the fully retracted position.
Figure 2:
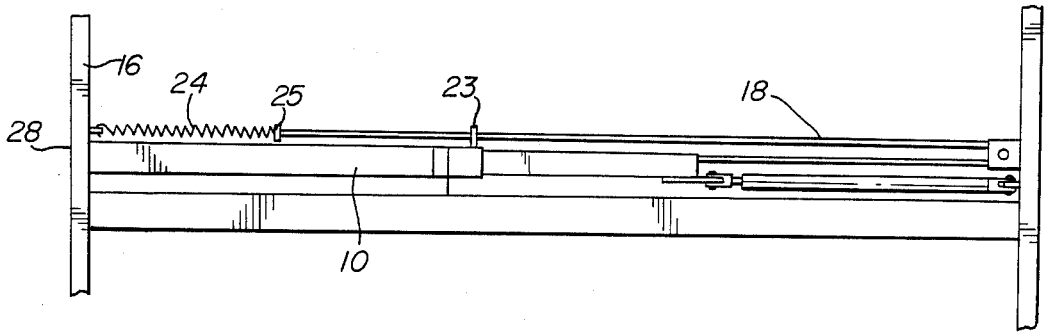
FIG. 2 is a plan view of the power beam in its fully retracted position.

As seen in FIGS. 1 and 2, the power beam consists of a beam channel 10 attached to the frame 16. Slideable beam 15 rides in slideable relationship within beam channel 10. Slidable beam 15 is driven linearly within beam channel 10 by hydraulic cylinder 12 between a fully retracted and a fully extended position. In alternate embodiments, other motive means may be used including a cable network or a threaded shaft which journals through a nut attached to the slideable beam 15. The cable 18 extends from its connection to fitting 25 on the end of spring 24, around pulley 22 which is attached to the frame 16, through slideable beam 15 and beam channel 10, around pulley 21 and thence to swivel connection 19 with selected sidewall/roof 20. The spring 24 serves to retain cable 18 and cable extension 28 taut at all times and to permit the slideable beam 15 to move to a position where torque may best be imparted to the selected sidewall/roof 20. The exposed segment 28 of cable 18 which extends between pulley 21 and swivel connection 19 is the segment along which force is imparted to produce the torque which rotates the selected sidewall/roof 20.

Figure 4:
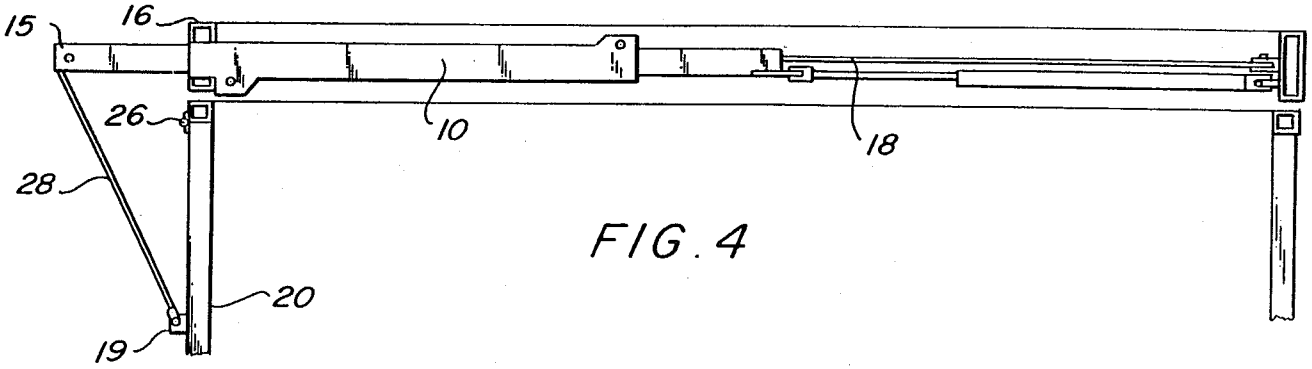
FIG. 4 is a side view of the power beam which has been actuated to the position where torque begins to be applied.
Figure 5:
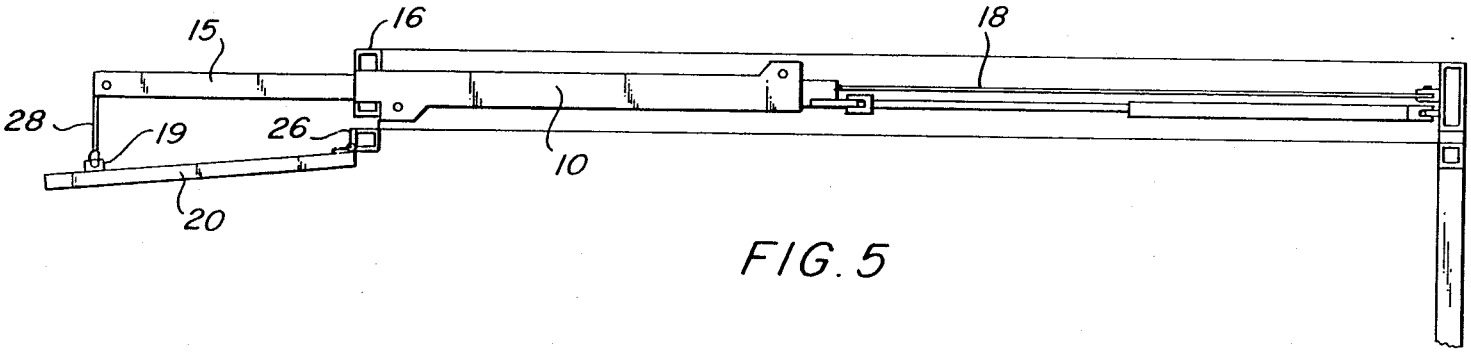
FIG. 5 is a side view of the power beam when fully extended.
Figure 6:
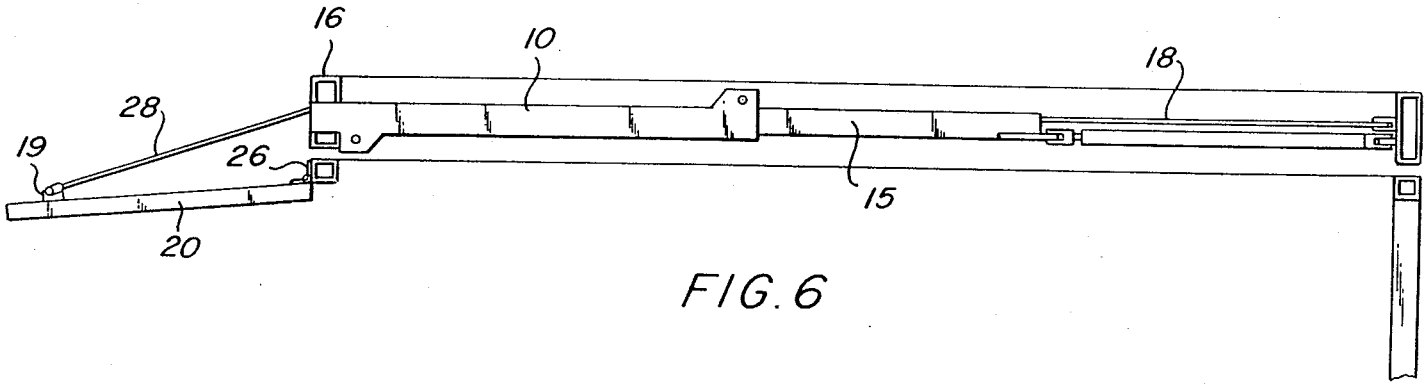
FIG. 6 is a side view of the power beam when fully extended and after the member 20 has been supported so that the beam channel may be withdrawn.
Figure 7:
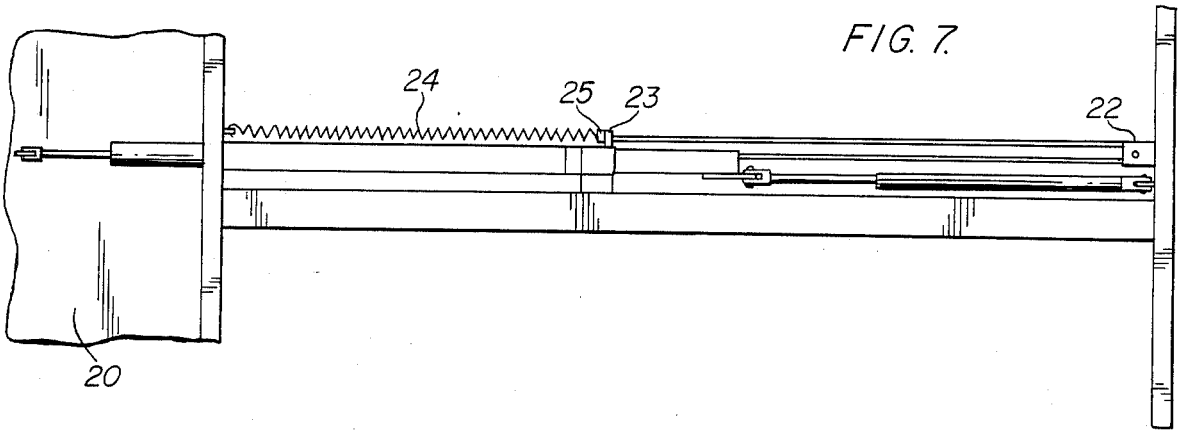
FIG. 7 is a plan view of the power beam in the partially extended position.
Figure 9:
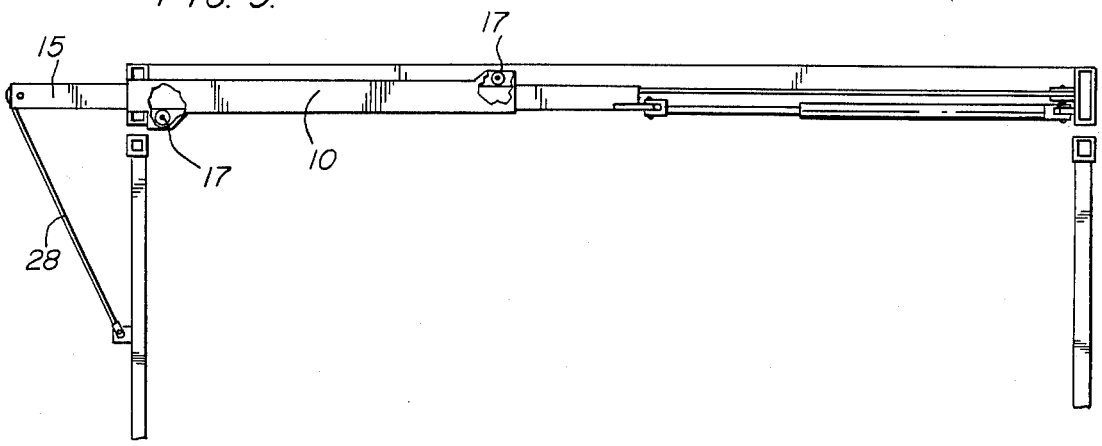
FIG. 9 is a further view with the beam channel being partially broken away to show rollers on which the beam slides in the preferred embodiment.

In operation, as shown first in FIGS. 1 and 4, the hydraulic cylinder 12 is actuated to force cylinder rod 11 against the extension 14 on the slideable beam 15. Beam 15 slides smoothly within the beam channel 10 due to the presence of roller units 17, shown particularly in the broken away view of FIG. 9. As the slideable beam 15 is driven outwardly, a force is imparted along cable extension 28 at the point of pulley 21 which is attached to the outer end of slideable beam 15. Due to the weight of the selected sidewall/roof 20 as well as to the small initial angle which cable extension 28 forms with the selected sidewall/roof 20, insufficient force is initially imparted along cable extension 28 to lift or rotate the selected sidewall/roof 20. Instead, since the force imparted along the cable 18 at pulley 21 is also communicated back along the cable, the spring 24 begins to stretch. Spring 24 continues to be stretched as slideable beam 15 moves outwardly until the fitting 25 on the end of the cable contacts stop member 23. Stop member 23 may be attached to the stationary beam channel 10 as shown in FIGS. 2 and 7 but, preferrably, is attached to slideable beam 15 in order to obtain a twofold mechanical advantage for the retraction of cable 18. Once fitting 25 contacts stop member 23 the end of cable 18 is held taut against stop member 23 and the force which continues to be imparted to the cable at pulley 21 increases until it is sufficient to rotate selected sidewall/roof 20 about hinge 26. At this point, the angle which is formed between the cable extension 28 of cable 18 and the selected sidewall/roof 20 is large enough to allow the force imparted along the cable to produce a significant torque. Since the angle is now appreciable the selected sidewall/roof 20 is no longer dead weight to be lifted, but a hinged member to be rotated. With the preferred attachment of stop member 23 to slideable beam 15 the rotation occurs faster due to the additional mechanical advantage gained in the travel of cable 18 by combining the movement of pully 21 against cable 18 with the movement of stop 23 against the fitting 25 on the end of cable 18. As shown in FIG. 5, when slideable beam 15 completes its outward travel, the selected sidewall/roof 20 has been lifted to a near horizontal position. Once the additional structural members of the expandable structure are driven into place, the selected sidewall/roof 20 will be held up by the sidewall and endwall members so that the sidewall/roof 20 will be held in place even when the slideable beam 15 is retracted, as shown in FIG. 6. It may be noted that the cable 18, and particularly the cable extension 28, remains taut when the beam 15 is withdrawn since the spring 24 draws up the slack.

Figure 10:
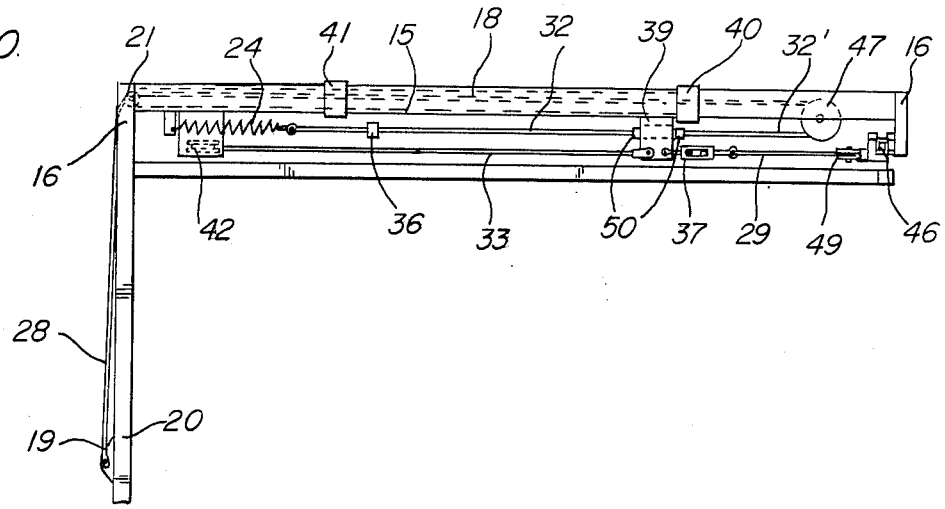
FIG. 10 is a side view of an alternate embodiment utilizing a cable network for actuation of the slideable beam.
Figure 11:
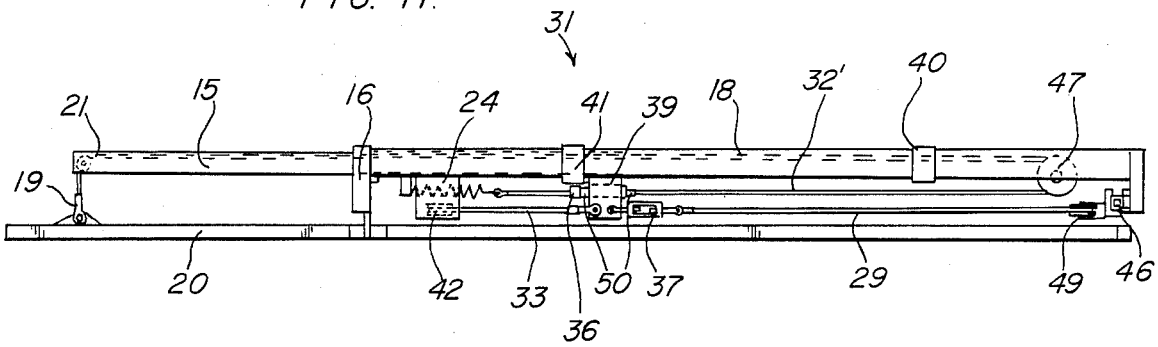
FIG. 11 is a side view of the alternate embodiment of FIG. 10 after the slideable beam is fully extended.
Figure 12:
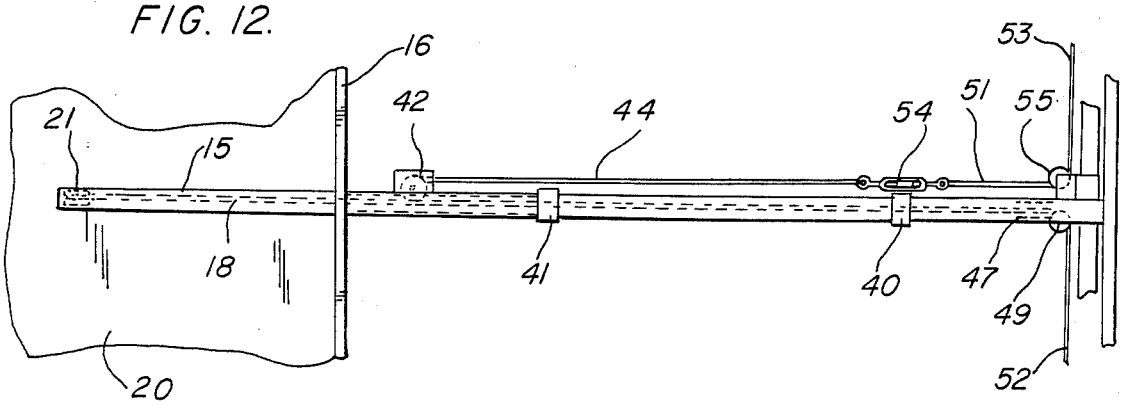
FIG. 12 is a plan view of FIG. 11.

An alternate embodiment of the power beam of the present invention is shown in FIGS. 10–12. In this embodiment the force for the movement of the slideable beam 15 is a cable and pully network whcih resides within the frame 16 and whose principal axis is transverse to the longitudinal dimension of the power beam enclosures 30. The cable network provides, at the rear of each power beam enclosure 30 opposite the operating end of the power beam 31, a pair of cables 52 and 53 which travel around sheaves 49 and 55, respectively, between a direction transverse to the longitudinal dimension of the power beam enclosure 30 and a direction along the axis of the power beam 31. Cables 52 and 53 are driven in a reciprocating fashion by the cable network such that cables 51 (a continuation of cable 53) and 29 (a continuation of cable 52) travel in opposite directions. Since cable 29 is connected by turnbuckle 37 to plate 39 which is in turn attached to slideable beam 15, and since cable 51 is connected through turnbuckle 54 and cables 44 and 33 to attachment plate 39, as the cables 52 and 53 are driven in reciprocal motion the associated cables 29 and 51 drive the slideable beam 15 between the withdrawn position (FIG. 10) and the fully extended position (FIG. 12).

The operation of the power beam 31 is the same as described above for the embodiments of FIGS. 1–2, 4–7 and 9. Thus, when the selected sidewall/roof 20 is in the vertical position, as shown in FIG. 10, the slideable beam 15 is fully retracted and the attachment plate 39 is in its rearmost position. Cable 51 and turnbuckle 54 are extended into power beam enclosure 30 and are positioned adjacent sheave 42. The length of cable section 44 is shortened and the length of cable section 33 is relatively greater. Then, cable 51 is pulled by cable 53 around around sheave 55; at the same time cable 29 moves into power beam enclosure 30 as slack is taken up from cable 52. Consequently, cable section 33 travels around sheave 42 to become cable section 44 and attachment plate 39 forces slideable beam 15 outwardly. Cable 18 is forced outwardly by its contact with pully 21 at the end of slideable beam 15, thereby drawing cable sections 32 and 32' into and through cable adjustors 50 and the opening in attachment plate 39. Spring 24 expands and ferrule 36 is drawn towards contact with the moving attachment plate 39. When cable adjustor 50 on attachment plate 39 contacts ferrule 36, cable sections 32 and 32' as well as cable 18 reverse direction since the slideable beam 15 continues to be driven by cable 53 and by cables 51, 44 and 33. As a result, torque is imparted by cable section 28 to rotate selected sidewall/roof 20 upwardly. Ferrule 36 continues to be moved along by the contact with attachment plate 39, and cable sections 32, 32', 18 and 28 are drawn behind in concert, until selected sidewall/roof 20 is completely raised. At this point in the operation spring 24 is completely collapsed, as shown in FIG. 11.

I claim:

1. A power beam for rotating a structural member about a hinged connection to a frame, comprising:

a channel member positioned adjacent said structural member and adjacent said hinged connection of said structural member to said frame;

a slideable beam within said channel member, said beam being disposed to slide within said channel member;

means for driving said slideable beam within said channel member in linear reciprocating movement;

cable means attached at one end to said structural member at a set distance from said hinged connection, said cable means contacting the end of said slideable beam which is nearest said attachment of said cable means to said structural member;

bias means attached between the other end of said cable means and said frame; and a stop member positioned adjacent said cable and adjacent said bias means whereby as said slideable beam experiences movement by said means for driving said slideable beam, said cable moves along with said slideable beam at its contact with said end of said beam and said cable draws against said bias means until said bias means reaches a limit at said stop member whereupon appreciable torque is applied by said cable to said structural member.

2. A power beam in accordance with claim 1 in combination with a first pulley attached to said end of said slideable beam at which said cable contacts said beam, whereby said cable runs around said first pulley and then runs within said slideable beam.

3. A power beam in accordance with claim 2 in combination with roller means within said hollow channel member to facilitate the travel of said slideable beam within said channel.

4. A power beam in accordance with claim 1 in combination with a second pulley attached to said frame at a location in opposition to said attachment of said hollow channel member to said frame whereby said cable runs around said first pulley, through said slideable beam and thence to said second pulley and thence to said attachment to said spring.

5. A power beam in accordance with claim 4 in which said spring is positioned adjacent and parallel with said channel member.

6. A power beam in accordance with claim 1 wherein said means for driving said slideable beam is a double acting hydraulic cylinder whose cylinder rod contacts an end of said slideable beam.

7. A power beam in accordance with claim 1 wherein said means for driving said slideable beam comprises in combination a threaded shaft and a threaded nut, said threaded nut being attached to said slideable beam and said threaded shaft journaling through said threaded nut whereby as said threaded shaft rotate said slideable beam is driven in said linear direction.

8. A power beam in accordance with claim 1 wherein said cable is attached at one end to a swivel contact on said structural member.

9. A power beam in accordance with claim 1 wherein said stop member is attached to said slideable beam.

10. A power beam in accordance with claim 1 wherein said means for driving said slideable beam is a cable and pulley network.

11. A power beam in accordance with claim 10 wherein said cable and pulley network comprises:

a pair of actuating cables, said pair of actuating cables being connected between a cable actuation network external to said power beam and an attachment to said slideable beam;

a pulley attached to said frame adjacent said structural member, one of said pair of actuating cables travelling around the sheave of said pulley;

an attachment plate, said plate being attached to said slideable beam and extending through a slit in said hollow channel member, said plate being connected to said one of said pair of actuating cables on the side adjacent said structural member and the other of said pair of actuating cables being connected to said plate on the side remote from said structural member;

whereby as said cables in said pair of actuating cables engage in reciprocal motion, said attachment plate drives said slideable beam.

* * * * *